US005963987A

United States Patent [19]

Walls

[11] Patent Number: 5,963,987

[45] Date of Patent: Oct. 12, 1999

[54] NECKTIE WITH NOVEL CONSTRUCTION AND CONFIGURATION

[76] Inventor: Jerry Kenneth Walls, 1907 Rosebank Ave., Nashville, Tenn. 37216

[21] Appl. No.: 09/102,336

[22] Filed: Jun. 22, 1998

[51] Int. Cl.[6] ..... A41D 25/00

[52] U.S. Cl. ..... 2/144

[58] Field of Search ..... 2/157, 156, 155, 2/147, 146, 145, 144, 130; D2/606

[56] References Cited

U.S. PATENT DOCUMENTS

| | | | |
|---|---|---|---|
| D. 150,851 | 9/1948 | Grinoch . | |
| D. 160,302 | 10/1950 | Cleveland et al. . | |
| D. 254,639 | 4/1980 | Brown | D2/351 |
| D. 258,622 | 3/1981 | Rosso | D2/351 |
| D. 321,276 | 11/1991 | Weeks | D2/605 |
| D. 324,942 | 3/1992 | Hillenmaaier et al. | D2/605 |
| D. 337,429 | 7/1993 | Grieco | D2/605 |
| D. 341,929 | 12/1993 | Gaffney | D2/605 |
| 1,310,192 | 7/1919 | Keys . | |
| 1,540,136 | 6/1925 | Laage . | |
| 2,269,577 | 1/1942 | Brohard . | |
| 3,261,025 | 7/1966 | Simek . | |
| 3,426,360 | 2/1969 | Ackerman | 2/146 |
| 3,562,814 | 2/1971 | Ackerman | 2/146 |
| 3,872,513 | 3/1975 | Beaudin et al. . | |
| 3,959,825 | 6/1976 | Hughes . | |
| 4,229,834 | 10/1980 | Alexander et al. | 2/146 |
| 4,506,389 | 3/1985 | Franklin | 2/144 |
| 4,610,037 | 9/1986 | Haymer | 2/145 |
| 4,627,113 | 12/1986 | Lord . | |
| 5,142,703 | 9/1992 | Basinger et al. . | |
| 5,463,779 | 11/1995 | Pinkus | 2/144 |

*Primary Examiner*—John J. Calvert
*Assistant Examiner*—Shirra L. Jenkins
*Attorney, Agent, or Firm*—John D. Gugliotta

[57] ABSTRACT

Neckwear with a novel construction and configuration is disclosed, consisting of a tie of otherwise traditional configuration that functions as a conventional tie, with a front face constructed of a variety of fabrics. Various combinations of several fabrics of varying materials are positioned on the front face of the necktie, below the knot, and are configured into various patterns. The structural fabric configurations include constructions incorporating braiding of fabrics, pleats, combinations of braiding and pleats, and overlapping fabric combinations, such as vertical left to right, diagonal, alternating diagonal, circular, and fish scale pleats as well as braided patterns. The remainder of the necktie is printed with a pattern that matches the aesthetic appearance created by the structural configurations that are located below the knot on the front face of the necktie.

14 Claims, 4 Drawing Sheets

NECKTIE WITH NOVEL CONSTRUCTION AND CONFIGURATION

RELATED APPLICATIONS

The present invention is a continuation of Disclosure Document Number filed on Aug. 15, 1997.

BACKGROUND OF THE INVENTION

1. Field of the Invention

The present invention relates generally to neckwear, and, more particularly, to a necktie with novel construction and configuration.

2. Description of the Related Art

Ties are an integral part of business attire for many men and some women. Ties are also worn for evening occasions and formal outings. Many individuals wear ties as a means of self-expression. For example, some wear ties with sporting scenes on them, letting others know what interests the wearer has.

Most ties use only one type of fabric in the construction of each tie. These ties have a solid, one-piece fabric front, onto which various patterns of color or pictures are drawn or ink imprinted. Such variations in prints and color have limited self-expression.

Structural variations between ties has basically been limited to varying dimensions of the one-piece, solid tie front face. As such, modes of self-expression via tie configuration and look have been limited to variations in color, prints and size of the front face of the tie. Current ties on the market do not provide enough variety to meet the various tastes of the millions of tie wearers in the United States, and have done little to tap into the multitude of variations in structural configurations, fabric arrangements and spatial relationships between the fabrics used to construct ties to create varieties of ties.

In the related art, several devices attempt to correct for the foregoing problem of limited self-expression. U.S. Pat. No. 4,229,834, issued in the name of Alexander et al., discloses a traditional style necktie and an improved method of manufacture utilizing a single interwoven double cloth fabric as a lining.

U.S. Pat. No. 4,610,037, issued in the name of Haymer, discloses a tie with a pre-formed knot which attaches via a neck strap or to a shirt button to hold the tie in place in lieu of a tie clip.

U.S. Pat. No. 4,506,389, issued in the name of Franklin, discloses an improved construction method for an otherwise traditional necktie.

U.S. Pat. No. 5,463,779, issued in the name of Pinkus, discloses a method for producing multiple ply ties consisting of like or dissimilar ply materials.

Other examples of devices disclosing variations in internal tie construction or external, ornamental designs include U.S. Pat. No. 3,562,814, issued in the name of Ackerman, U.S. Pat. No. 3,426,360, issued in the name of Ackerman, U.S. Pat. No. 3,824,627, issued in the name of Schon, U.S. Pat. No. D 324,942, issued in the name of Hillenmaier et al., U.S. Pat. No. D 321,276, issued in the name of Weeks, U.S. Pat. No. D 337,429, issued in the name of Grieco, U.S. Pat. No. D 254,639, issued in the name of Brown, and U.S. Pat. No. D 258,622, issued in the name of Rosso.

A search of the prior art did not disclose any patents that read directly on the claims of the instant invention. Consequently, a need has been felt for providing an apparatus and method which overcomes the problems cited above.

SUMMARY OF THE INVENTION

It is therefore an object of the present invention to provide an improved necktie with novel construction and configuration that uses a front face of varying structural configurations to provide a novel appearance for a necktie, provides a continuity of aesthetic appearance throughout the exterior surface of the necktie, functions identically to a traditional necktie, and uses a variety of different materials.

Briefly described according to one embodiment of the present invention, a necktie with a novel construction and configuration is disclosed, consisting of a tie of otherwise traditional configuration that functions as a conventional tie, with a front face constructed of various combinations of fabrics, such as silk, cotton, nylon, leather, suede and other common fabrics well known to the garment industry. The fabric positioned on the front face of the necktie, below the knot, is configured in a vertical, left to right pleated configuration. The remainder of the necktie is printed with a pattern that matches the aesthetic appearance created by the structural configuration that is located below the knot on the front face of the necktie.

It is envisioned that other embodiments of the present invention will include various structural fabric configurations include constructions incorporating braiding of fabrics, pleats, combinations of braiding and pleats, and overlapping fabric combinations, such as diagonal, alternating diagonal, circular, and fish scale pleats as well as braided patterns.

It is another object of the present invention to provide a line of neckwear that takes advantage of variations in structural configurations of the fabrics used to make the necktie. This provides the benefit of expanding the ability of individuals to express their particular preferences and tastes via their ties by providing ties that do not depend on variations in color and patterns to distinguish the tie from other ties.

It is another object of the present invention to provide a necktie that is easy to tie. This is accomplished by forming the exterior surfaces of the necktie, except for the front face, via a conventional, flat fabric construction.

| DESCRIPTIVE KEY | |
|---|---|
| 10 | a necktie with novel construction and configuration |
| 20 | main body |
| 30 | bottom |
| 40 | top |
| 50 | top portion |
| 60 | bottom portion |
| 70 | front face |
| 80 | fabric |
| 90 | pleats |
| 100 | pattern |
| 110 | enhancement strip |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

In order to describe the complete relationship of the invention, it is essential that some description be given to the manner and practice of functional utility and description of a necktie with novel construction and configuration 10.

The best mode for carrying out the invention is presented in terms of its preferred embodiment, herein depicted within the FIGS. 1 through 3 and 5.

1. Detailed Description of the Figures

Figure 1:
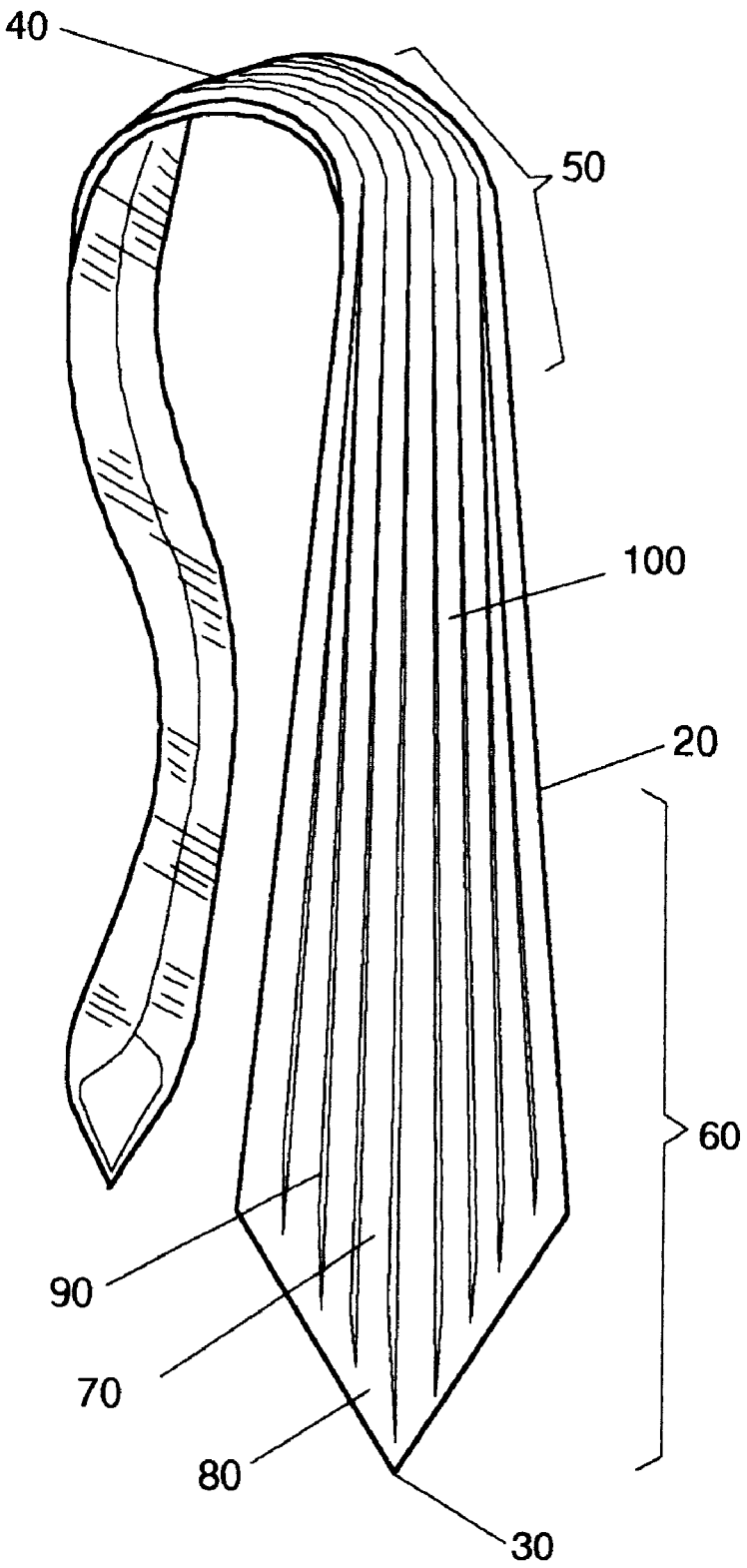
FIG. 1 is a front perspective of the preferred embodiment of a necktie with novel construction and configuration 10.

Referring now to FIG. 1, according to one embodiment of the present invention, a necktie with novel construction and configuration 10 is shown, according to the present invention, comprises a necktie main body 20 of otherwise traditional, elongated, generally rectangular configuration, with a bottom 30 and a top 40. The main body 20 is made up of a top portion 50, used as a neck band. The bottom portion 60 of the main body 20 is of greater width than the top portion 50. The bottom portion 60 has a front face 70 that faces outward toward onlookers when worn by a user.

It is envisioned that the present invention functions as a conventional tie, with a front face 70 of the bottom portion 60 of the main body 20 constructed of various combinations of fabrics 80, such as silk, cotton, nylon, leather, suede and other common fabrics 80 well known to the garment industry.

In the preferred embodiment, the fabric 80 on the front face 70 is configured using folding techniques commonly used in the fabric 80 industry, to create a plurality of pleats 90. The pleats 90 extend vertically, parallel to the elongated centerline of the main body 20 of the necktie, and parallel to each other. Each pleat 90 extends the entire length of the bottom portion 60. The pleats 90 extend laterally, outward from the centerline of the main body 20, with those pleats 90 located left of the centerline facing left and those pleats 90 located right of the elongated centerline facing right. The width of each pleat 90 is constant, and all pleats 90 are of similar size. The lateral distance between the ends of the pleats 90 is similar to those commonly used on shirts and pants by the fabric 80 industry.

The pleats 90 in the fabric 80 positioned on the front face 70 of the main body 20 terminates near the middle of the elongated centerline of the main body 20, in a location such that when the necktie is worn in a conventional manner by a plurality of individuals of differing heights, the pleats 90 are located below the knot, in the bottom portion 60 of the main body 20.

Figure 2:
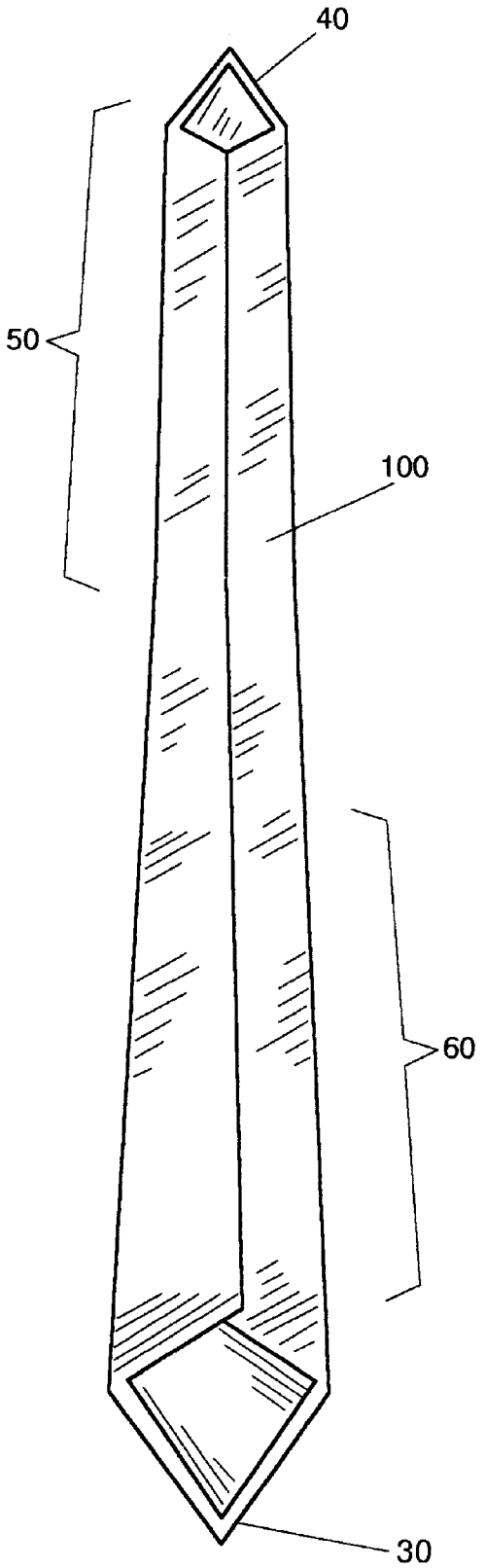
FIG. 2 is a back perspective view thereof.
Figure 3:
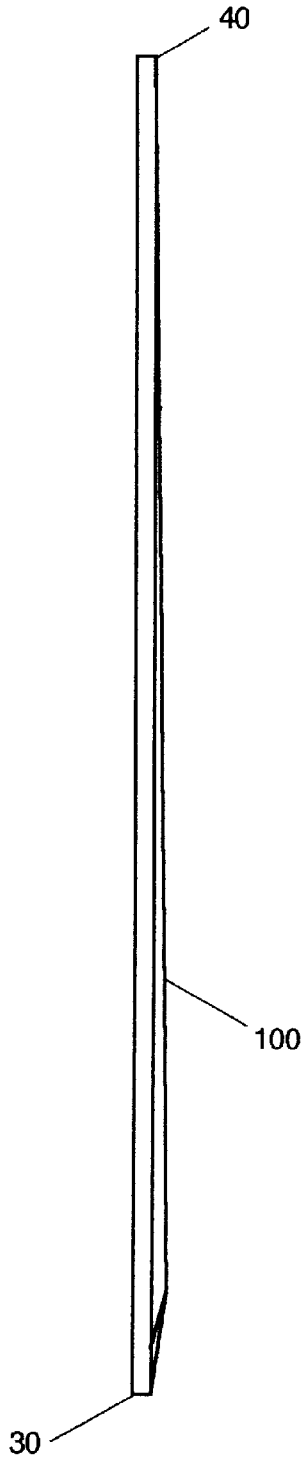
FIG. 3 is a right side view thereof, the left side view being a mirror image of the right side view.

Referring now to FIGS. 2 & 3, the remainder of the necktie, located above the pleats 90, in the top portion 50 of the main body 20, is printed with a pattern 100 that corresponds to and mimics the aesthetic appearance created by the structural configuration that is located below the knot on the front face 70 of the main body 20. The pattern 100 is located on the front and back surfaces of the top portion 50 of the main body 20 of the necktie. The pattern 100 can be imprinted on the fabric 80 using a variety of color media of varying textures, as is commonly used in the fabric 80 industry.

It is envisioned that other styles and configurations of the front face 70 and pattern 100 of the necktie can be easily incorporated into the teachings of the present invention, and the several configurations shown and described are for purposes of clarity and disclosure and not by way of limitation of scope.

Referring now to FIGS. 4*a*–4*f*, it is envisioned that other embodiments of the present invention will include various structural fabric 80 configurations include constructions incorporating braiding of fabrics 80, pleats 90, combinations of braiding and pleats 90, and overlapping fabric 80 combinations, such as a braided pattern 100, pleating 90 running left or right, diagonal pleating 90, alternating diagonal pleating 90, circular pleating 90, and fish scale pleating 90, respectively.

Figure 4A:
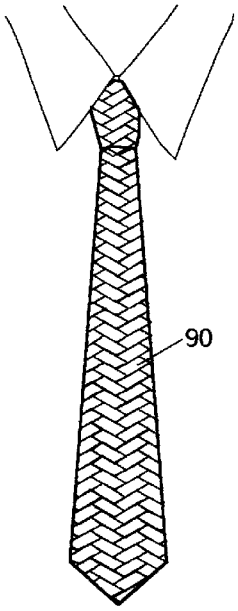
FIG. 4*a* is a front perspective view of an alternate embodiment of the present invention with braided pattern.
Figure 4B:
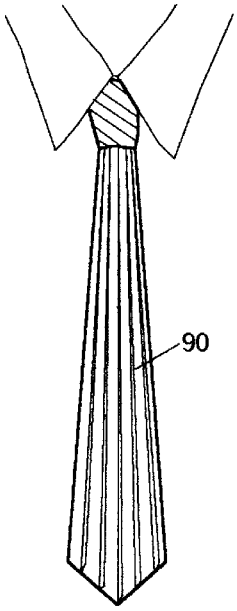
FIG. 4*b* is a front perspective view of an alternate embodiment of the present invention with pleating positioned facing left.
Figure 4C:
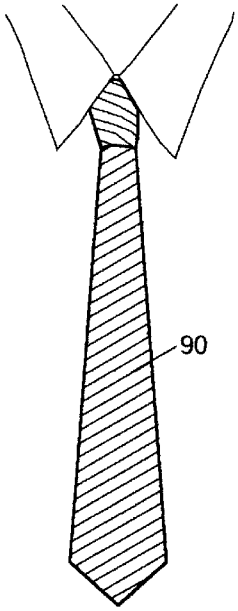
FIG. 4*c* is a front perspective view of an alternate embodiment of the present invention with diagonal pleating.
Figure 4D:
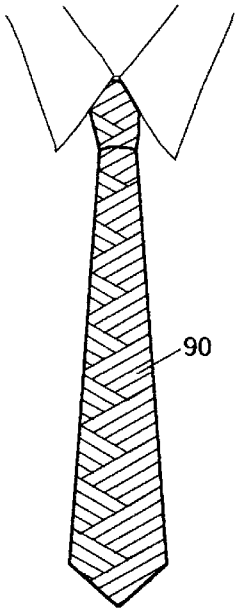
FIG. 4*d* is a front perspective view of an alternate embodiment of the present invention with alternating diagonal pleating.
Figure 4E:
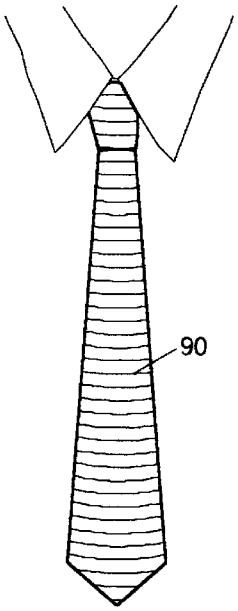
FIG. 4*e* is a front perspective view of an alternate embodiment of the present invention with circular pleating.
Figure 4F:
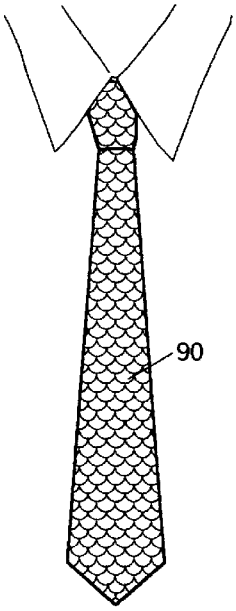
FIG. 4*f* is a front perspective view of an alternate embodiment of the present invention with fish scale pleating.
Figure 4G:
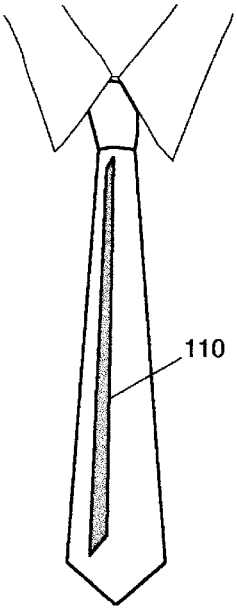
FIG. 4*g* is a front perspective view of an alternate embodiment of the present invention with leather accenting.

Referring now to FIG. 4*g*, it is also envisioned that enhancement strips 110, of an elongated rectangular configuration, made from either leather or suede, may be positioned vertically on the front face 70 of the bottom portion 60, being sewn into the structure of the front face 70 of the bottom portion 60 using sewing procedures presently available in the sewing community.

2. Operation of the Preferred Embodiment

Figure 5:
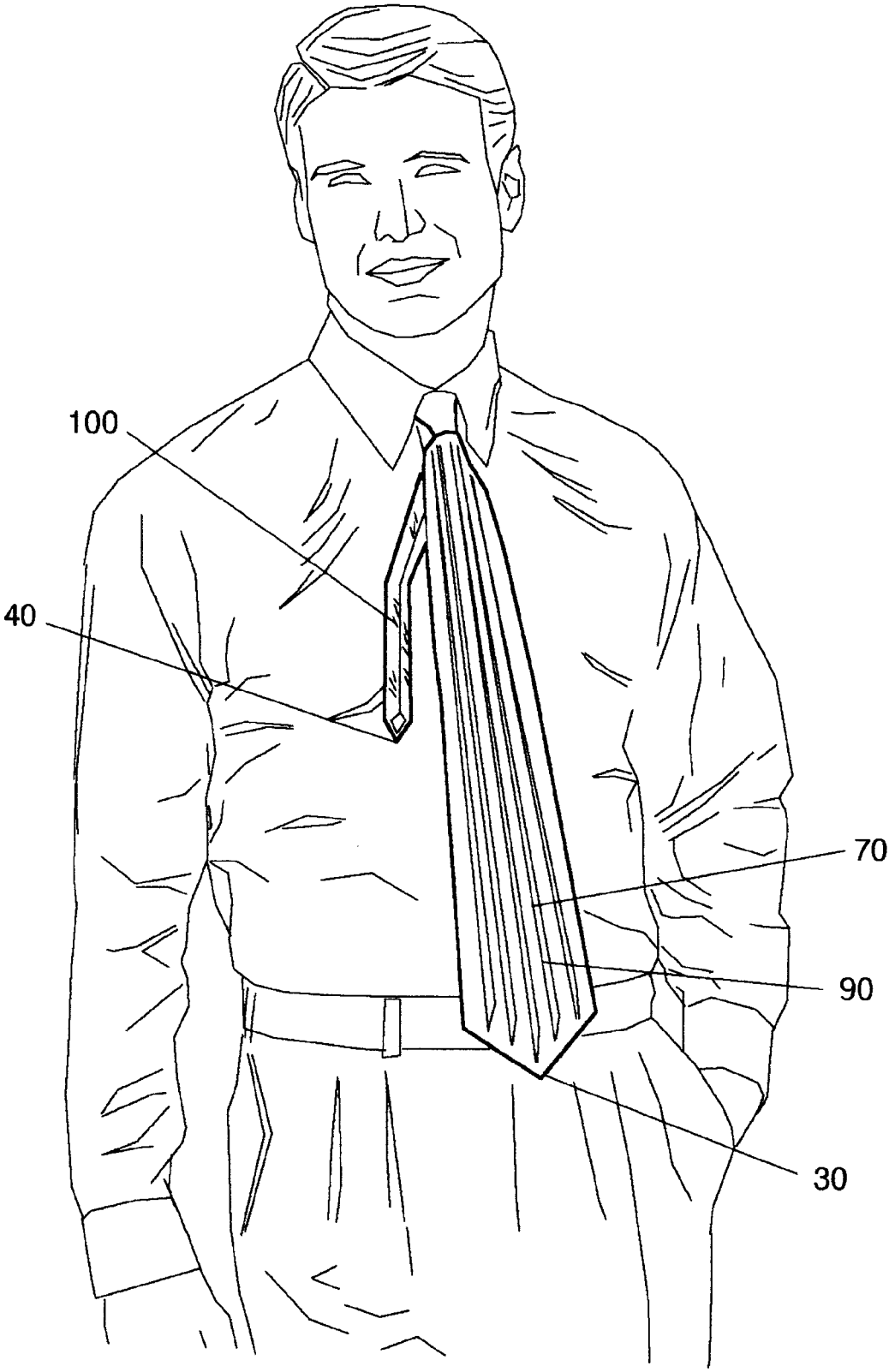
FIG. 5 is a front view of the preferred embodiment of the present invention in use.

Referring now to FIG. 5, to use the present invention, the top portion 50 of the main body 20 is positioned along the neck of a user, and tied in any one of the traditional tie configurations, such as half-Windsor or full Windsor. As such, the present invention functions and is used in a manner identical to a traditional necktie.

The foregoing description is included to illustrate the operation of the preferred embodiment and is not meant to limit the scope of the invention. The scope of the invention is to be limited only by the following claims.

What is claimed is:

1. A necktie with a novel construction and configuration, said necktie comprising:

a necktie main body of an elongated, generally rectangular configuration, with a bottom and a top;

a top portion of said main body, said top portion for use as a neck band a bottom portion of said main body having an outward facing front face;

said top portion of said main body being printed with a pattern that corresponds to and mimics an aesthetic appearance created by a structural configuration that is located below a knot on the front face of the main body;

and wherein said front face is configured using a plurality of pleats, each said pleat extending parallel to each other, and extending the entire length of said bottom portion.

2. The necktie of claim 1, wherein said pleats are positioned on said front face of said main body such as to terminate near the middle of the elongated centerline of the main body, in a location such that when the necktie is worn in a conventional manner by a plurality of individuals of differing heights, the pleats are located below the knot, in the bottom portion of the main body.

3. The necktie of claim 1, wherein said printed pattern is located on the front and back surfaces of the top portion of the main body of the necktie.

4. The necktie with a novel construction and configuration of claim 1, wherein said pleats are facing right when facing the user wearing the present invention.

5. The necktie with a novel construction and configuration of claim 1, wherein said pleats are angled to the left when facing the user wearing the present invention.

6. The necktie with a novel construction and configuration of claim 1, wherein said pleats are angled to the right when facing the user wearing the present invention.

7. The necktie with a novel construction and configuration of claim 1, wherein said pleats are of a fish scale configuration.

8. The necktie with a novel construction and configuration of claim 1, wherein there is one said pleat, made from leather.

9. The necktie with a novel construction and configuration of claim 1, wherein said pleats are horizontal in configuration.

10. The necktie with a novel construction and configuration of claim 1, wherein said pleats are of an alternating, left and right angled configuration.

11. The necktie with a novel construction and configuration of claim 1, wherein said pleats are facing left when facing the user wearing the present invention.

12. A necktie with a novel construction and configuration, said necktie comprising:

a necktie main body of an elongated, generally rectangular configuration, with a bottom and a top;

a top portion of said main body, said top portion for use as a neck band;

a bottom portion of said main body having an outward facing front face;

said top portion of said main body being printed with a pattern that corresponds to and mimics an aesthetic appearance created by a structural configuration that is located below a knot on the front face of the main body;

and wherein said front face is configured using a plurality of braided strips, each said braided strip extending vertically, parallel to the elongated centerline of the main body of the necktie, and parallel to each other, and extending the entire length of said bottom portion.

13. The necktie of claim 12, wherein said braided strips are positioned on said front face of said main body such as to terminate near the middle of the elongated centerline of the main body, in a location such that when the necktie is worn in a conventional manner by a plurality of individuals of differing heights, the braided strips are located below the knot, in the bottom portion of the main body.

14. The necktie of claim 1, wherein said printed pattern is located on the front an back surfaces of the top portion of the main body of the necktie.

* * * * *